US005429125A

United States Patent [19]

Wagner et al.

[11] Patent Number: 5,429,125

[45] Date of Patent: Jul. 4, 1995

[54] OXYGEN MASK APPARATUS

[76] Inventors: Kurt J. Wagner; Tina M. Wagner, both of R.R. #2, Bellevue, Iowa 52031

[21] Appl. No.: 102,894

[22] Filed: Aug. 6, 1993

[51] Int. Cl.[6] ..... A62B 7/02

[52] U.S. Cl. ..... 128/205.25; 128/204.18; 128/205.24

[58] Field of Search ..... 128/205.25, 205.24, 128/203.29, 204.11, 203.21, 205.22, 205.21, 201.26, 201.28, 201.29, 206.18, 206.21, 206.29, 204.18, 204.27, 205.16; 251/94, 95; 222/3; 2/5

[56] References Cited

U.S. PATENT DOCUMENTS

| | | | |
|---|---|---|---|
| 2,818,859 | 10/1956 | Peterson | 128/200.28 |
| 2,897,817 | 8/1959 | Marina | 128/205.25 |
| 4,078,561 | 3/1978 | Hanson | 128/201.6 |
| 4,233,970 | 11/1980 | Kranz | 128/205.24 |
| 4,440,163 | 4/1984 | Spergel | 128/205.25 |
| 4,582,054 | 4/1986 | Ferrer | 128/205.25 |
| 4,702,243 | 10/1987 | Smith | 128/205.4 |
| 4,938,211 | 7/1990 | Takahashi et al. | 128/201.27 |
| 4,945,458 | 7/1990 | Batts et al. | 2/5 |
| 5,243,972 | 9/1993 | Huang | 128/205.25 |
| 5,357,945 | 10/1994 | Messina | 128/205.25 |

*Primary Examiner*—Edgar S. Burr
*Assistant Examiner*—William J, Deane, Jr.

[57] ABSTRACT

An oxygen mask for providing a supply of oxygen to an occupant of a structure during a fire. The oxygen mask includes a pressurized gas cylinder coupled to a face mask for supplying oxygen to the user and can be operated by a removal of a safety pin and a subsequent actuation of a button which allows oxygen to flow into the face mask. A charge gauge is provided for indicating a charge status of the gas cylinder and alternate embodiments of the present invention include an eye cover assembly for protecting a user's eyes and a light assembly for illuminating an area in front of the user.

4 Claims, 4 Drawing Sheets

FIG 1
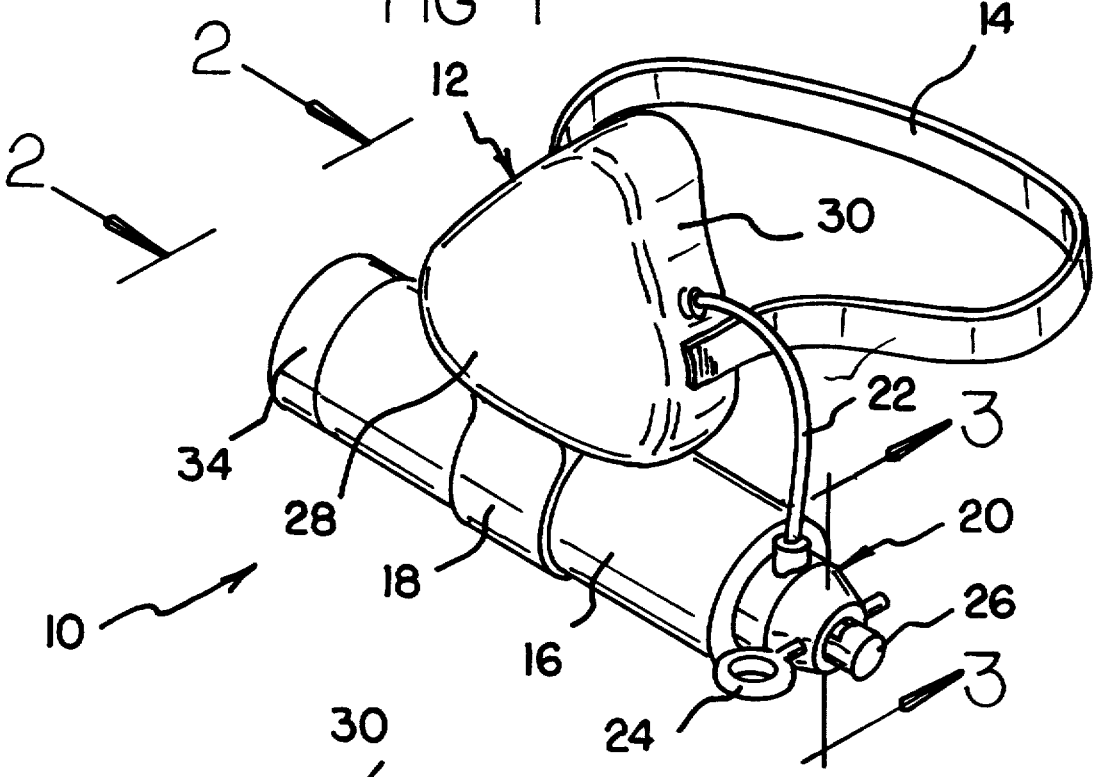
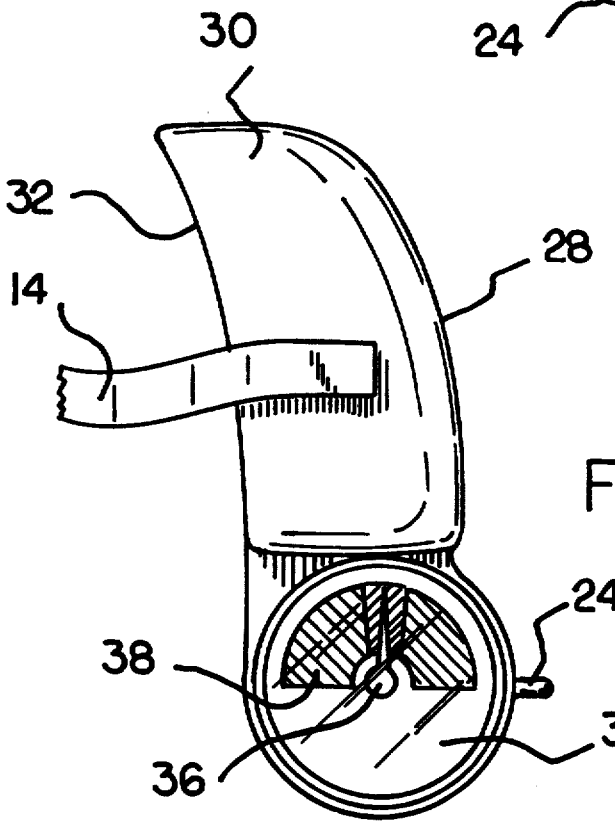
FIG 2

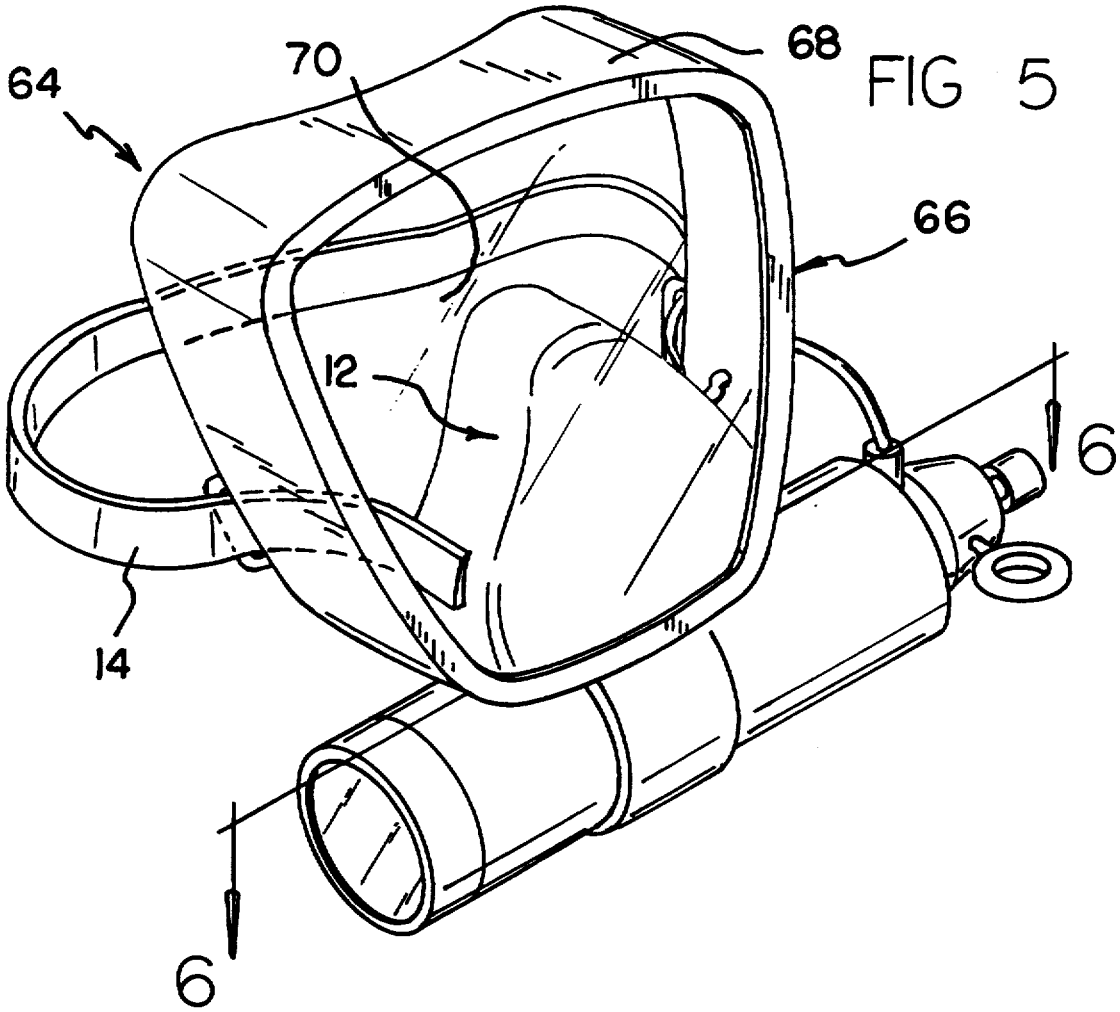
FIG 5
FIG 6
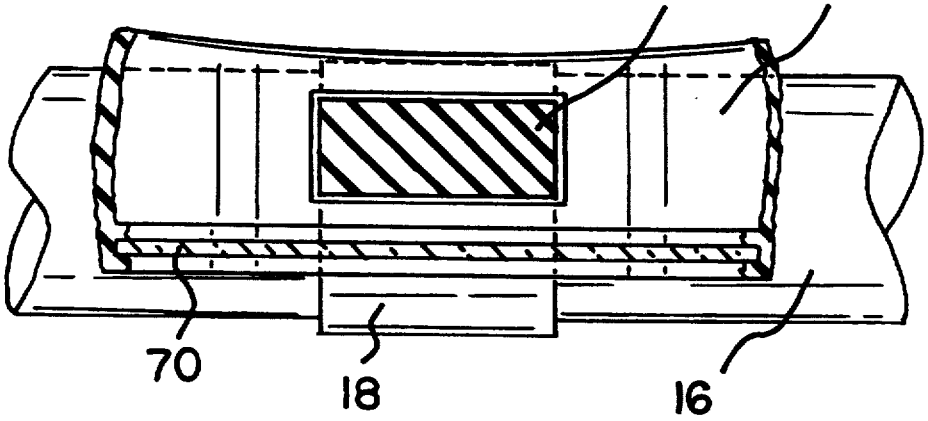

OXYGEN MASK APPARATUS

BACKGROUND OF THE INVENTION

1. Field of the Invention

The present invention relates to gas masks and more particularly pertains to an oxygen mask apparatus for providing a supply of oxygen to an occupant of a structure during a fire.

2. Description of the Prior Art

The use of gas masks is known in the prior art. More specifically, gas masks heretofore devised and utilized for the purpose of supplying oxygen to a user are known to consist basically of familiar, expected and obvious structural configurations, notwithstanding the myriad of designs encompassed by the crowded prior art which have been developed for the fulfillment of countless objectives and requirements.

For example, a disposable cooled oxygen mask is illustrated in U.S. Pat. No. 3,545,437 which is formed of a dual-walled thermoplastic material shaped to be sealed around the nose and mouth of a wearer and includes an interior pocket operable to receive a coolant medium such as alcohol while the region between the interior mask panel and the wearer's mouth and nose receives an oxygen supply.

An oxygen mask is described in U.S. Pat. No. 4,201,205 for being secured over the nose and mouth of a user or patient and includes an improved means for securing the mask comprising a non-elastic flexible tubing adapted to be extended over both ears of the user.

Another patent of interest is U.S. Pat. No. 3,850,168 which discloses an oxygen mask apparatus comprising a quickly installable, head-worn breathing apparatus having a tiltable, essentially rigid, elliptical ring at the rear of the apparatus frame for engaging the back of the crown of the wearer's head, making the apparatus universally adapted for heads of different sizes. Springs in the side members of the frame maintain the face mask in a pressurized relationship with the wearer's nose and mouth and a quick release mechanism is provided for coupling the face mask with a valve body.

While these devices fulfill their respective, particular objectives and requirements, the aforementioned patents do not describe an oxygen mask for providing a supply of oxygen to an occupant of a structure during a fire which includes a pressurized gas cylinder coupled to face mask that can be operated by a removal of a safety pin and a subsequent actuation of a button which allows oxygen to flow into the face mask. Furthermore, the prior art makes no mention of a charge gauge for indicating a charge status of the gas cylinder, an eye cover assembly for protecting a user's eyes, and a light assembly for illuminating an area in front of a user.

In these respects, the oxygen mask apparatus according to the present invention substantially departs from the conventional concepts and designs of the prior art, and in so doing provides an apparatus primarily developed for the purpose of providing a supply of oxygen to an occupant of a structure during a fire.

SUMMARY OF THE INVENTION

In view of the foregoing disadvantages inherent in the known types of gas masks now present in the prior art, the present invention provides a new oxygen mask apparatus construction wherein the same can be utilized for providing a supply of oxygen to an occupant of a structure during a fire. As such, the general purpose of the present invention, which will be described subsequently in greater detail, is to provide a new oxygen mask apparatus which has many of the advantages of the gas masks mentioned heretofore and many novel features that result in a oxygen mask apparatus which is not anticipated, rendered obvious, suggested, or even implied by any of the prior art gas masks, either alone or in any combination thereof.

To attain this, the present invention essentially comprises an oxygen mask for providing a supply of oxygen to an occupant of a structure during a fire. The oxygen mask includes a pressurized gas cylinder coupled to a face mask for supplying oxygen to the user and can be operated by a removal of a safety pin and a subsequent actuation of a button which allows oxygen to flow into the face mask. A charge gauge is provided for indicating a charge status of the gas cylinder and alternate embodiments of the present invention include an eye cover assembly for protecting a user's eyes and a light assembly for illuminating an area in front of the user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new oxygen mask apparatus which has many of the advantages of the gas masks mentioned heretofore and many novel features that result in a oxygen mask apparatus which is not anticipated, rendered obvious, suggested, or even implied by any of the prior art gas masks, either alone or in any combination thereof.

It is another object of the present invention to provide a new oxygen mask apparatus which may be easily and efficiently manufactured and marketed.

It is a further object of the present invention to provide a new oxygen mask apparatus which is of a durable and reliable construction.

An even further object of the present invention is to provide a new oxygen mask apparatus which is susceptible of a low cost of manufacture with regard to both materials and labor, and which accordingly is then susceptible of low prices of sale to the consuming public, thereby making such oxygen mask apparatuses economically available to the buying public.

Still yet another object of the present invention is to provide a new oxygen mask apparatus which provides in the apparatuses and methods of the prior art some of the advantages thereof, while simultaneously overcoming some of the disadvantages normally associated therewith.

Still another object of the present invention is to provide a new oxygen mask apparatus for providing a supply of oxygen to an occupant of a structure during a fire.

Yet another object of the present invention is to provide a new oxygen mask apparatus which includes a pressurized gas cylinder coupled to a face mask for supplying oxygen to a user.

Even still another object of the present invention is to provide a new oxygen mask apparatus including both an eye cover assembly for protecting a user's eyes and a light assembly for illuminating an area in front of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a first embodiment of an oxygen mask apparatus comprising the present invention.

FIG. 2 is a side elevation view of the present invention as viewed from line 2—2 of FIG. 1.

FIG. 5 is a perspective view of a second embodiment of an oxygen mask apparatus comprising the present invention.

FIG. 6 is a cross sectional view taken along line 6—6 of FIG. 5.

DESCRIPTION OF THE PREFERRED EMBODIMENTS

Figure 3:
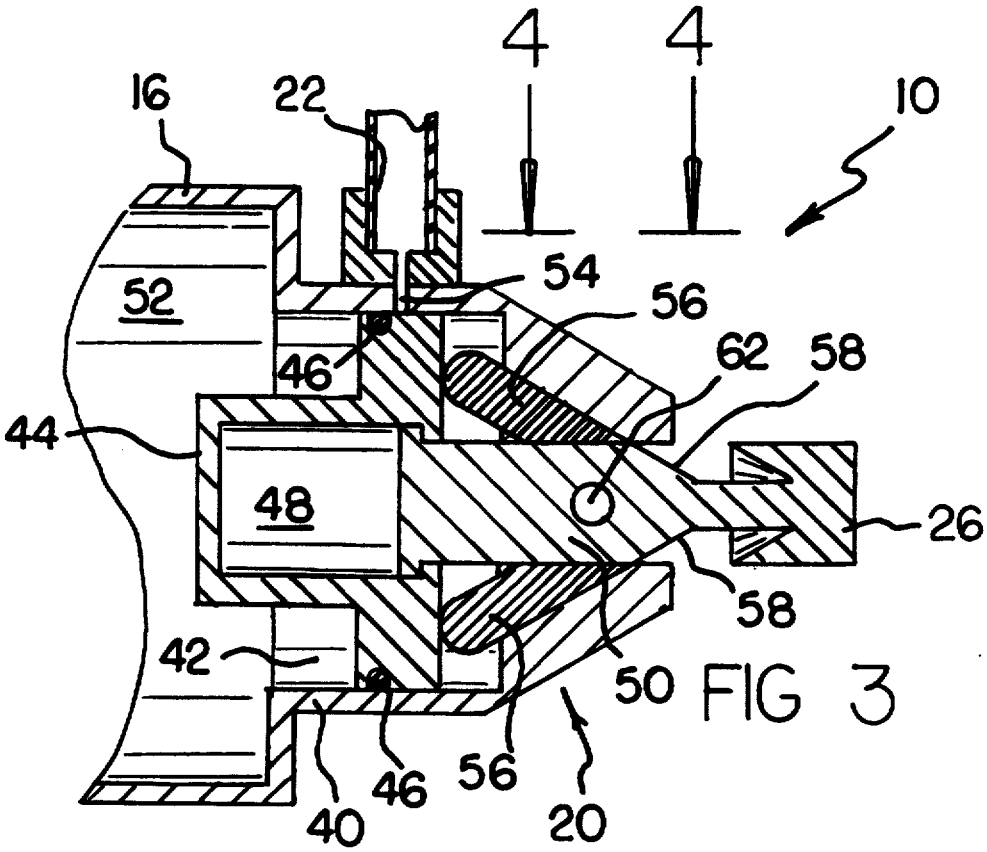
FIG. 3 is a cross sectional view taken along line 3—3 of FIG. 1.
Figure 4:
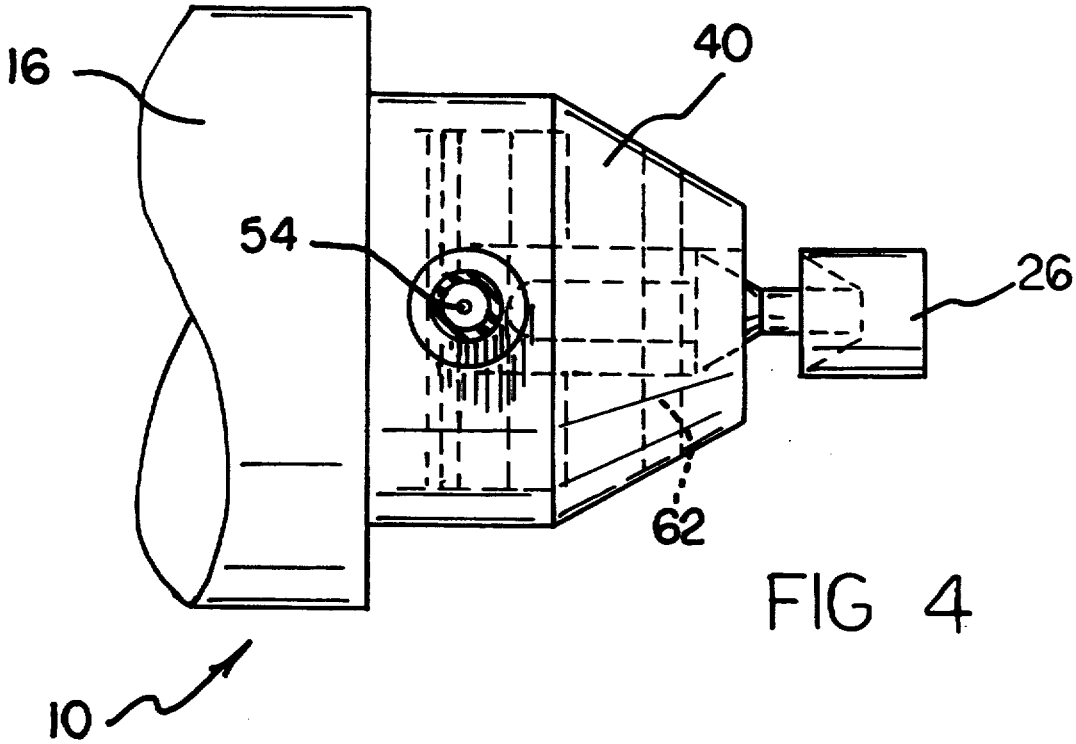
FIG. 4 is a top plan view of the present invention as viewed from line 4—4 of FIG. 3.

With reference now to the drawings, and in particular to FIGS. 1–4 thereof, a new oxygen mask apparatus embodying the principles and concepts of the present invention and generally designated by the reference numeral 10 will be described.

The oxygen mask apparatus 10 comprises a face mask 12 adapted to be positioned over the nose and mouth of a user. The face mask 12 includes a head strap 14 connected to respectively opposed sides thereof which is operable to encompass a user's head, thereby securing the face mask to the user. A gas container 16 is secured to a lower area of the face mask 12 by a container strap 18, as best illustrated in FIG. 1. The gas container is a hollow cylindrical member containing a pressurized supply of oxygen or other breathable air therewithin which may be selectively dispensed through a valve assembly 20 and a supply tube 22 into an interior of the face mask 12, whereby a user may breathe such air.

In use, the oxygen mask apparatus 10 can be placed over the nose and mouth of the user and secured thereto by a placement of the head strap 14 over the user's head in a well understood manner. A safety pin 24 may then be removed from the valve assembly 20 which will permit a user to depress a button 26 to actuate the valve assembly. The oxygen mask apparatus 10 will provide a source of oxygen or other breathable air to the user during a fire or other emergency, thereby avoiding an inhalation of smoke typical of most structure fire deaths. In the preferred embodiment, the gas supply will provide a user with breathable air for approximately ten minutes.

More specifically, it will be noted that the oxygen mask apparatus 10 comprises a face mask 12 having a substantially triangularly shaped front portion 28 which is integrally or otherwise connected to a side portion 30 so as to define an unlabeled interior space operable to receive a user's nose and mouth. The side portion 30 includes a contour portion 32 which is operable to follow the contour of a user's face and provide a substantial seal therebetween. A head strap 14 comprised of a substantially flexible strap material having a pair of ends is connected to the face mask 12 at its ends on respectively opposed sides of the face mask. The head strap 14 is operable to resiliently secure the face mask 12 to a user's face.

Carried below the face mask 12 is a gas container 16 comprising a substantially cylindrical, hollow container having a valve assembly 20 integrally or otherwise secure to an end thereof, as best illustrated in FIG. 1. The gas container 16 is captured by a container strap 18 which passes through a portion of the face mask 12 and forms a loop around the gas container. A charge gauge 34 is positioned at another end of the gas container 16 and is operable to detect a pressure of gas within the container through conventional mechanical pressure sensing means. The charge gauge 34 includes a needle 36 rotatably positioned upon a scale 38, whereby a position of the needle with respect to the scale will indicate a charge status of the gas container.

FIG. 3 details the operational components of the valve assembly 20 and it can be shown from this Figure that the valve assembly comprises a valve body 40 which is integrally or otherwise present at an end of the gas container 16. The valve body 40 is shaped so as to define an interior cylinder 42 having a substantially circular cross section in which a piston 44 is slidably disposed upon a piston seal 46. The piston 44 includes a cavity 48 in which a plunger 50 is partially captured. The plunger 50 is free to slide in and out of the cavity 48 and projects outwardly therefrom to an exterior of the valve body 40. The piston 44 is positioned in such a manner so as to block fluid communication between an interior 52 of the gas container 16 and a valve body aperture 54 to which the supply tube 22 connects. A pair of firing pins 56 are disposed within unlabeled channels of the valve body and are arranged at an acute angle with respect to a longitudinal axis of the plunger 50. The firing pins 56 abut both the piston 44 and the plunger 50, thereby precluding a forward movement of the piston.

The plunger 50 includes an angled neck area 58 integrally formed therein defining the button 26 outwardly therefrom. The plunger 50 is precluded from moving with respect to the valve body 40 by the safety pin 24 which extends through safety pin apertures 62 in both the plunger and the valve body. Upon a removal of the safety pin 24, the button 26 may be depressed to push the plunger 50 into the cavity 48 of the piston 44. This being done, the firing pins 56 may then slide into the angled neck area 58 of the plunger 50, thereby allowing a pressure of the gas contained within the interior 52 of the gas cylinder 16 to bias the piston 44 towards a front of the valve body 40 whereby fluid contained therein may pass through the valve body aperture 54 and subsequently into the face mask 12.

A second embodiment of the present invention as generally designated by the reference numeral 64, which comprises substantially all of the features of the foregoing embodiment 10 and which further comprises an eye cover assembly 66 will now be described. As best shown in FIGS. 5–6, it can be shown that the eye cover assembly 66 comprises a flexible frame 68 formed of any substantially elastomeric material and shaped to conform to the facial contours of a user. The flexible frame 68 supports an eye cover lens 70 in a spaced relationship from the user's face and further supports the face mask 12 on an interior surface thereof. The head strap 14 is secured at its ends to respectively opposed sides of the flexible frame 68 of the eye cover assembly 66 and is operable to secure the oxygen mask apparatus 64 to a user in a well understood manner.

FIG. 6 details the coupling between the container strap 18 and the flexible frame 68 of the second embodiment 64. The container strap 18 is formed of a loop of a substantially resilient strap material and includes a flat base 72 formed of a substantially non-flexible material. The flexible frame 68 includes an unillustrated elongated aperture through which the loop of the container strap 18 may pass. However, the flat base 72 will not pass through the elongated aperture. In this manner, the gas cylinder 16 may be positioned within the loop of the container strap 18 where, by a function of the design, it is secured to the eye cover assembly 66. In addition, the face mask 12 and the eye cover assembly 66 may be formed as separate components and then secured together by a passage of the container strap 18 through elongated apertures in both the face mask and the eye cover assembly. Alternatively, the face mask 12 and the eye cover assembly 66 may be integrally molded as a single unit.

Figure 7:
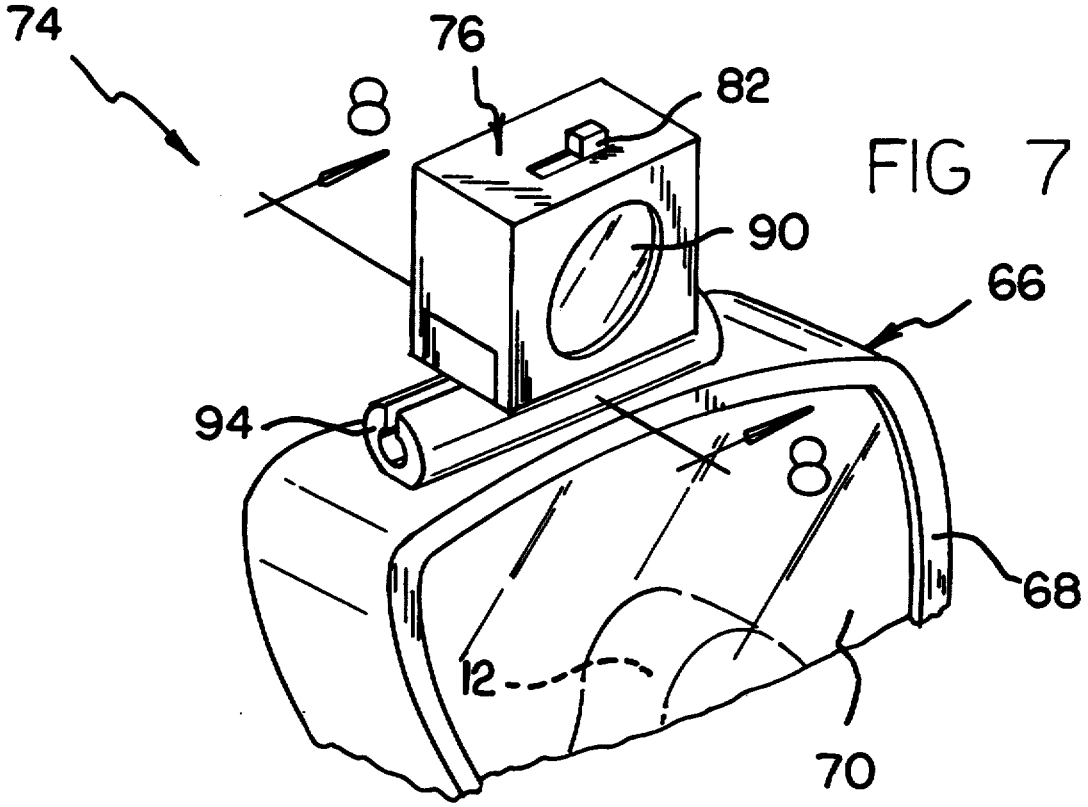
FIG. 7 is a perspective view of a portion of a third embodiment of an oxygen mask apparatus comprising the present invention.
Figure 8:
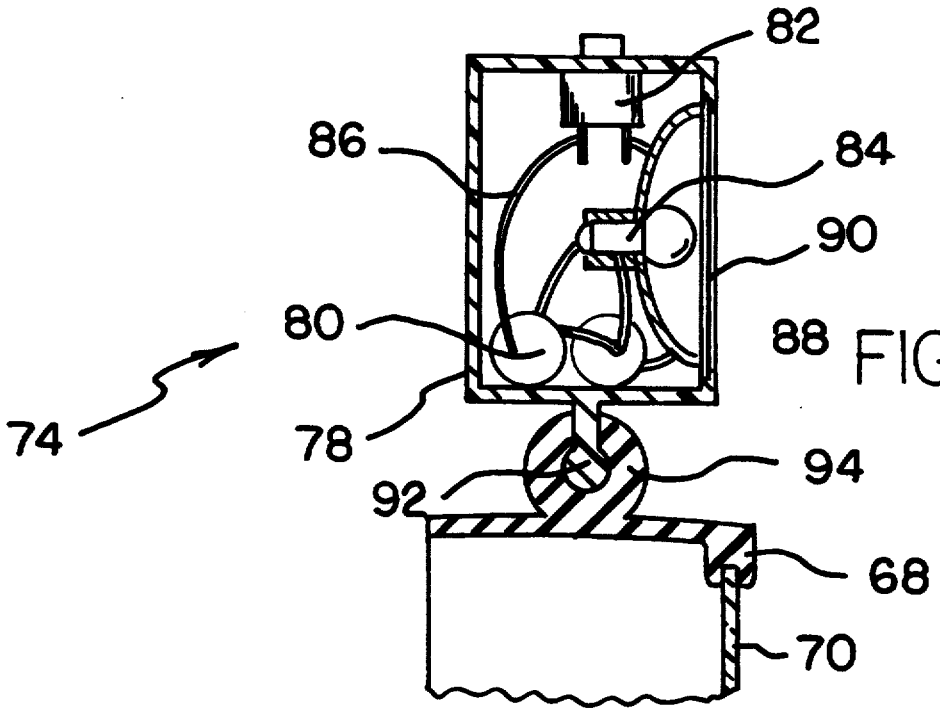
FIG. 8 is a cross sectional view taken along line 8—8 of FIG. 7 of the third embodiment.

Comprising all of the features and structure of the previous embodiments 10, 64 is a third embodiment which is generally designated by the reference numeral 74 and may be viewed in FIGS. 7–8. It can be shown that the third embodiment 74 further comprises a light assembly 76 which may be selectively positioned upon a top area of the eye cover assembly 66. The light assembly 76 comprises a light assembly case 78 having a substantially rectangular shape along all of its dimensions and containing a plurality of batteries 80 therein, as best illustrated in FIG. 8. The batteries 80 are connected to both a switch 82 and a light bulb 84 by wires 86 in a conventional manner such that an operation of the switch 82 will energize the light bulb. The light bulb 84 is positioned within a parabolic dish 88 which provides a sharp focused beam of light. The dish 88 is positioned within the case 78 behind a light lens 90.

The case includes an elongated projection 92 along a bottom area thereof which is operable to be received within a substantially C-shaped channel 94 that is integrally or otherwise fixedly secured to the flexible frame 68 of the eye cover assembly 66, as best illustrated in FIG. 8. The channel 94 allows the light assembly 76 to be moved to either the left or the right side of the eye cover assembly 66 and further allows the light assembly to be pivoted slightly up or down, thereby allowing an accurate placement of the light generated thereby. The light assembly 76 is operable to illuminate an area in front of the user, thereby allowing the user to vacate a smoke filled structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oxygen mask apparatus comprising:

a face mask for covering both a nose and a mouth of a user, said face mask having a side portion and an interior;

a head strap having a pair of ends, said pair of ends being connected to respectively opposed areas of said side portion of said face mask;

a gas container coupled to said face mask and operable to releasably contain a volume of pressurized gas; and, a valve assembly means for selectively supplying said pressurized gas to said interior of said face mask, said valve assembly means comprising a valve body coupled to said gas container in fluid communication with an interior of said gas container, said valve body being shaped so as to define an interior cylinder and a valve body aperture in fluid communication with said face mask; a piston slidably disposed within said interior cylinder, said piston being shaped so as to define a cavity in a center area thereof; a plunger partially disposed within said cavity and being slidable relative to said piston, said plunger having an angled neck area extending therearound, with said valve body being further shaped so as to define at least one channel formed therein and positioned at an acute angle relative to a longitudinal axis of said plunger; and a firing pin slidably disposed within said channel, whereby said firing pin abuts a portion of said plunger and a portion of said piston to hold said piston within said interior cylinder in a position which precludes fluid communication through said valve body aperture, whereby said plunger can be biased into said cavity of said piston to permit said firing pin to slide into said angled neck area of said plunger to permit said piston to slide to a front of said valve body, thereby allowing fluid communication through said valve body aperture.

2. The new oxygen mask apparatus of claim 1, and further comprising an eye cover assembly means coupled to said face mask for covering a user's eyes.

3. The new oxygen mask apparatus of claim 1, and further comprising a light assembly means coupled to said eye cover assembly means for illuminating an area proximal said user.

4. A new oxygen mask apparatus comprising: a face mask for covering both a nose and a mouth of a user, said face mask having a side portion and an interior; a head strap having a pair of ends, said pair of ends being connected to respectively opposed areas of said side portion of said face mask; an eye cover assembly means coupled to said face mask for covering a user's eyes; a light assembly means coupled to said eye cover assembly means for illuminating an area proximal said user; a gas container coupled to said face mask and operable to releasably contain a volume of pressurized gas; and a valve assembly means for selectively supplying said pressurized gas to said interior of said face mask, wherein said valve assembly means comprises a valve body coupled to said gas container in fluid communication with said pressurized gas, said valve body being shaped in such a manner so as to define a valve body aperture in fluid communication with said face mask and an interior cylinder; a piston slidably disposed within said interior cylinder, said piston being shaped in such manner so as to define a cavity in a center area thereof; a plunger partially disposed within said cavity and being slidable with respect to said piston, said plunger having an angled neck area therearound; at least one channel formed in said valve body and arranged at an acute angle with respect to a longitudinal axis of said plunger; and at least one firing pin slidably disposed within said at least one channel, whereby said at least one firing pin abuts a portion of said plunger and a portion of said piston to hold said piston within said interior cylinder in a position which precludes fluid communication through said valve body aperture, and whereby said plunger may be biased into said cavity of said piston to allow said at least one firing pin to slide into said angled neck area thereby allowing said piston to slide to a front of said valve body, thereby allowing fluid communication through said valve body aperture.

* * * * *